US007524159B2

(12) United States Patent
Mammone et al.

(10) Patent No.: US 7,524,159 B2
(45) Date of Patent: Apr. 28, 2009

(54) METHOD OF RECEIVING AND TRANSPORTING SOLID WASTE

(75) Inventors: Antonio Mammone, Richmond Hill (CA); Daniel Mammone, Concord (CA)

(73) Assignee: U Box It Inc., Concord, Ontario (CA)

( * ) Notice: Subject to any disclaimer, the term of this patent is extended or adjusted under 35 U.S.C. 154(b) by 180 days.

(21) Appl. No.: 11/400,894

(22) Filed: Apr. 10, 2006

(65) Prior Publication Data

US 2007/0237612 A1 Oct. 11, 2007

(51) Int. Cl.
*B65F 3/00* (2006.01)
*E02D 3/00* (2006.01)

(52) U.S. Cl. ..... 414/812

(58) Field of Classification Search ..... 414/470, 414/812; 298/18; 229/3.1, FOR. 105
See application file for complete search history.

(56) References Cited

U.S. PATENT DOCUMENTS 3,168,959 A 2/1965 Chandler et al.
3,583,164 A * 6/1971 Sherrill ..... 405/129.15
3,729,107 A * 4/1973 Present ..... 100/35
3,762,454 A * 10/1973 Wilkins, Jr. ..... 383/1
3,799,379 A 3/1974 Grether et al. ..... 214/515
4,184,587 A 1/1980 Hallstrom ..... 198/750
4,278,390 A 7/1981 Ahearn
4,371,208 A * 2/1983 Stricker ..... 298/23 D
4,525,100 A 6/1985 Zawadzki, Jr. et al.
4,542,774 A * 9/1985 Stavlo ..... 141/1
4,642,007 A * 2/1987 Marshall et al. ..... 410/78
4,745,952 A * 5/1988 French ..... 141/1
4,975,019 A * 12/1990 Cate et al. ..... 414/812
5,078,560 A * 1/1992 Patrick et al. ..... 410/68

(Continued)

FOREIGN PATENT DOCUMENTS

DE 24 33 168 A1 * 1/1976

(Continued)

OTHER PUBLICATIONS

2 Photographs of Side Dumping Truck sold and used prior to filing date of US application.

(Continued)

*Primary Examiner*—James Keenan
(74) *Attorney, Agent, or Firm*—Ballard Spahr Andrews & Ingersoll, LLP

(57) ABSTRACT

A method of receiving and transporting solid waste includes providing a strong, disposable waste container and a disposable pallet for supporting the container when the latter is loaded with waste. After loading, both the pallet and the container can be lifted onto a rear transporting section of a truck. In one version, the pallet and container are placed on a rear end section of the truck and moved to a forward position by a conveyor system. A forklift unit can be used to lift and move the container and pallet. In another version, the truck has movable sidewall members that can be moved from an upright position to a second position that allows the pallet and container to be loaded from a longitudinal side of the truck. For this method, the truck is equipped with a tiltable rear transporting section to allow the container and pallet to be dumped at the disposal site. In one version, this truck is tilted towards one longitudinal side in order to dump.

11 Claims, 11 Drawing Sheets

U.S. PATENT DOCUMENTS

| | | | | | |
|---|---|---|---|---|---|
| 5,163,555 | A | * | 11/1992 | West et al. | 206/386 |
| 5,174,415 | A | | 12/1992 | Neagle et al. | |
| 5,222,590 | A | | 6/1993 | Quaeck | 198/550 |
| 5,362,198 | A | * | 11/1994 | Patrick | 414/810 |
| 5,415,516 | A | | 5/1995 | Richards | |
| 5,505,580 | A | | 4/1996 | Alstad et al. | |
| 5,522,494 | A | | 6/1996 | Lutz | 198/750 |
| 5,641,261 | A | | 6/1997 | Talbert et al. | |
| 5,934,474 | A | * | 8/1999 | Renninger et al. | 206/600 |
| 6,062,806 | A | * | 5/2000 | Kern | 414/572 |
| 6,120,232 | A | * | 9/2000 | Dubosh et al. | 414/467 |
| 6,530,739 | B1 | | 3/2003 | Fridman | 414/467 |
| 6,675,937 | B2 | | 1/2004 | De Leeuw et al. | |
| 6,685,404 | B2 | * | 2/2004 | Udivich et al. | 410/42 |
| 2001/0000464 | A1 | * | 4/2001 | Beale | 414/607 |

FOREIGN PATENT DOCUMENTS

| | | | |
|---|---|---|---|
| ES | 2 021 254 A | * | 10/1991 |
| JP | 4-44973 | * | 2/1992 |

OTHER PUBLICATIONS

Advertising Leaflet or Catalogue page entitled All Terrain Pallet Jack published by Vestil Manufacturing Corporation more than one year prior to filing date of US application.

Published drawing of T & S Equipment entitled All Terrain Pallet Truck, All-T-2, dated Jun. 1, 2004.

* cited by examiner

METHOD OF RECEIVING AND TRANSPORTING SOLID WASTE

BACKGROUND OF THE INVENTION

This invention relates to methods of receiving and transporting solid waste and garbage.

Various types of vehicles are known for transporting waste and garbage to a disposable site. Some of these waste disposal vehicles employ a fork lift on the front, rear or side thereof which can be used to lift a relatively large, metal container from one position to another or which can be used on some trucks to lift and dump a large steel container so that the contents of the waste container are deposited into a hold in the vehicle. In many cases, the forklift devices on these vehicles are constructed only to lift containers having pockets or sleeves on the sides thereof for insertion of fork arms.

A variety of forklift vehicles or units are known and are capable of lifting a pallet loaded with boxes or other items or products. It is also known to provide a system whereby a forklift unit can be mounted at the rear end of a truck in order to transport the forklift unit to a work site. For example, U.S. Pat. No. 6,530,739 issued Mar. 11, 2003 teaches a forklift that can be mounted on a carrier vehicle, the forklift including a frame, a mast connected to the frame, and a fork carriage having a pair of forks extending therefrom and adapted to be vertically displacable on the mast. The vehicle includes a rear mounting end with at least one fork receiver adapted to receive the pair of forks therein and to allow complete lifting of the forklift off a ground surface by vertically displacing the fork carriage. Another, earlier patent disclosing a forklift vehicle and method of mounting same on the rear end of a truck is U.S. Pat. No. 3,799,379 issued Mar. 26, 1974 to T. H. A. Grether et al.

It is a common practice to provide a large, steel waste disposal bin at a construction site for the disposal of waste materials and, in particular, waste construction materials. However, it can be unduly expensive to use this method for disposing of construction waste under some circumstances, for example, on a small construction site where the amount of waste may not be very great or on a "do it yourself" construction site where the construction work or renovations may progress relatively slowly, for example, at the pace that the homeowner is prepared to work on the project.

Another difficulty with the large, known waste disposal bins is that in order to deliver these bins to a waste producing site or job site, a relatively large truck is required and generally this truck must be fitted with special features to enable it to deposit the large container or bin at a suitable location at the site. When the waste container has eventually been filled, this relatively large truck must then return to the construction or other site in order either to pick-up the large container and its contents for transport to a waste disposal site or to dump the contents of the waste container into a waste containing box of the truck and then leave the waste container at the site for further use.

According to one aspect of the present disclosure, a method of receiving and transporting solid waste for affecting disposal thereof includes providing a disposable waste container having a capacity of at least 500 pounds of suitable, solid waste and a disposable pallet capable of supporting the waste container when the container is loaded with this solid waste. After the container has been loaded in whole or in part by the user with the container resting on and supported by the pallet and the waste container is ready for transport to a disposal site, the pallet and container are lifted and moved onto a rear end section of a truck. Then the pallet and waste container together are moved to a forward position on a transporting bed of the truck by means of a conveyor system arranged on and forming at least a substantial portion of the transporting bed. The pallet and container are later transported by means of the truck to a waste disposal site for disposal thereof at this site.

According to one version of this method, the disposable waste container is constructed of strong corrugated cardboard panels which are biodegradable and coated on an exterior surface thereof with a water and moisture impervious layer.

According to another aspect of the present disclosure, a method of receiving and transporting solid waste such as waste generated at a construction, renovation, or clean-up site includes providing a disposable waste container having a waste capacity of at least 500 pounds of suitable solid waste and a disposable pallet capable of supporting the waste container when the container is loaded with the solid waste to a user at a waste producing site. After the container has been loaded in whole or in part by the user with the container resting on and supported by the pallet and is ready for transport to a disposal site, the pallet and waste container are lifted and moved onto a transporting bed of a truck by means of a separate forklift unit. The truck has a rear transporting portion that includes a transporting bed. This rear transporting portion has longitudinally extending sidewall members that can be moved from an upright transporting position on a respective longitudinal side of said transportation portion to a second position which allows said container to be loaded onto the truck, and at least one of these sidewall members is moved to the second position to allow the pallet and waste container to be loaded onto the transporting bed from the respective longitudinal side of the transporting portion. The waste disposal truck also has a raising mechanism for raising the rear transporting portion from a horizontal transporting position to a sloping position for dumping contents of the transporting portion. The pallet and container are transported by means of the truck to a waste disposal site and then the pallet and the waste container are dumped at the waste disposal site by operating the raising mechanism.

According to one version of this method of receiving and transporting waste, the forklift unit is transported to the waste producing site by means of the truck when the waste container is ready for transport to the disposal site. The forklift unit is unloaded from the truck prior to using the forklift unit to lift and move the pallet and waste container onto the transporting bed.

Further features and advantages of the methods of receiving and transporting solid waste according to the present disclosure will become apparent from the following detailed description taken in conjunction with the accompanying drawings.

DETAILED DESCRIPTION OF EMBODIMENTS OF THE INVENTION

Figure 1:
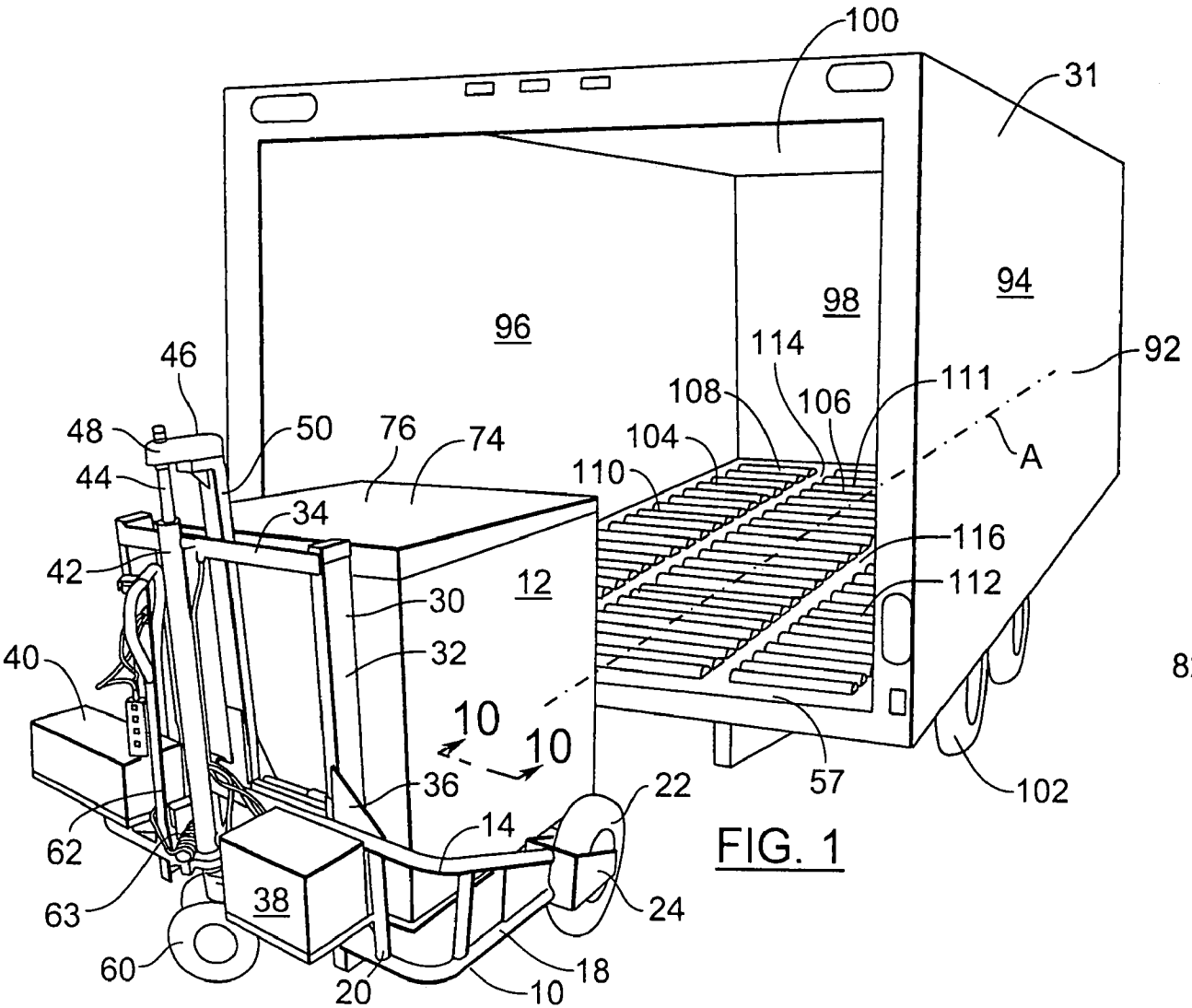
FIG. 1 is a perspective view of a forklift unit with a disposable waste container mounted thereon and a truck for transporting the waste container to a waste disposal site, the truck and the forklift unit being seen from the rear and from one side thereof.
Figure 2:
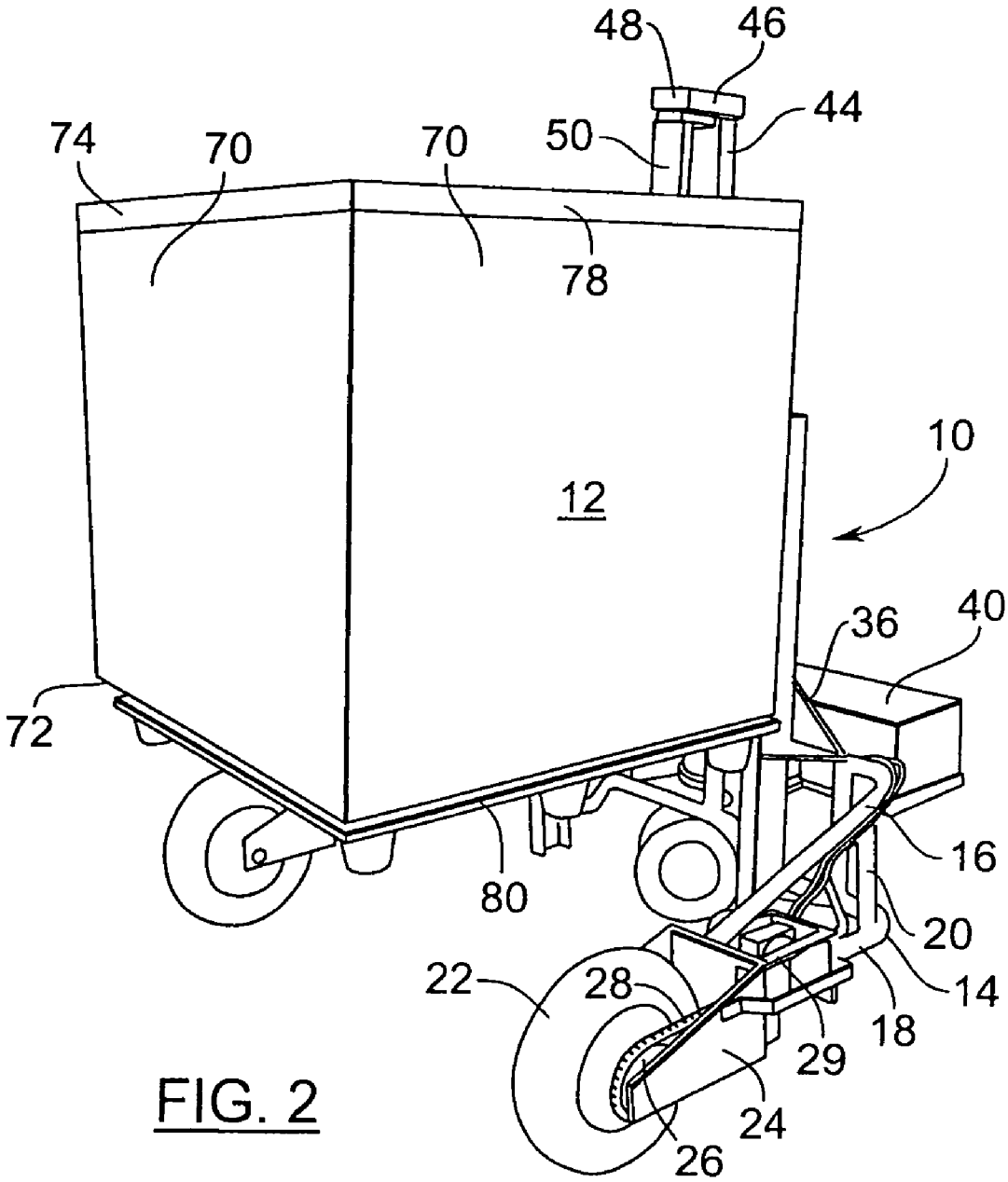
FIG. 2 is a perspective view of the forklift unit and waste container shown in FIG. 1, this view being taken from the front and from the opposite side of the forklift unit and this view showing the waste container in a raised position.
Figure 3:
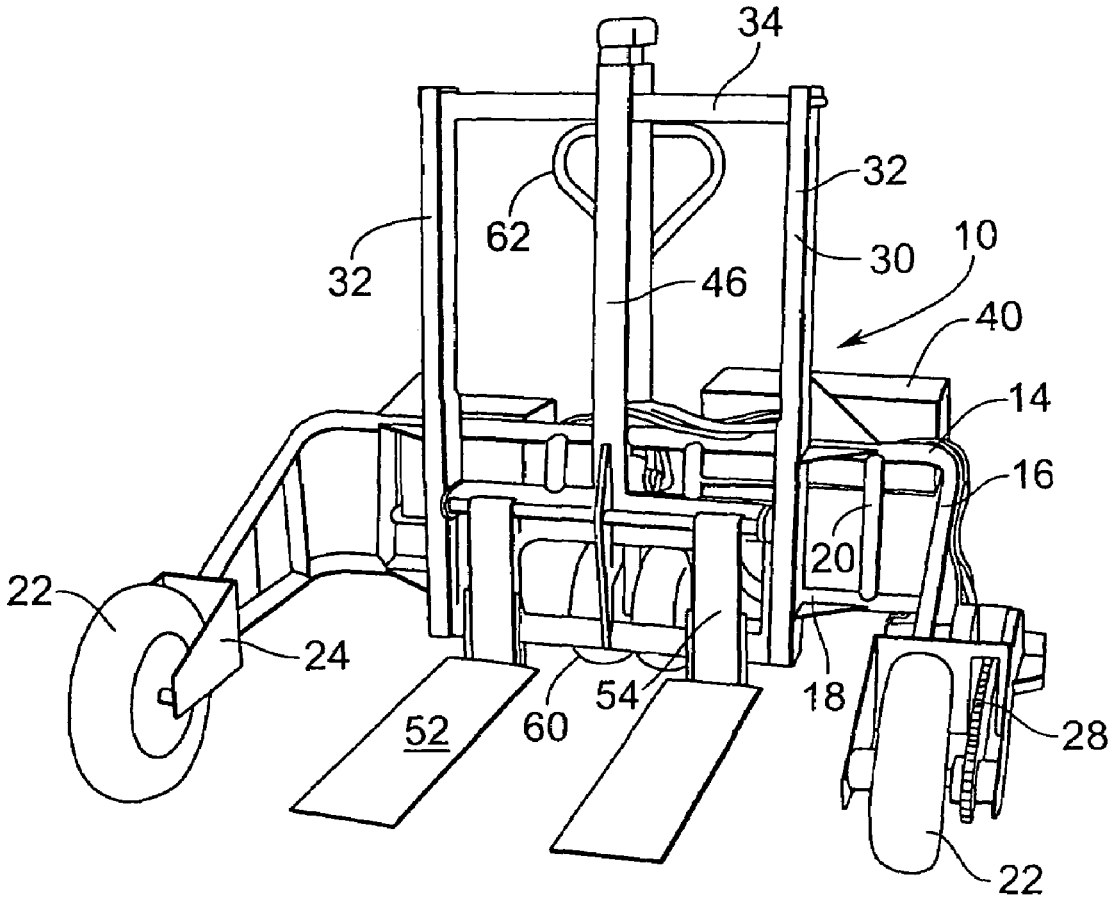
FIG. 3 is a perspective view of the forklift unit of FIG. 1, this view being taken from the front side and from above.

The above mentioned drawings illustrate several methods of receiving and transporting solid waste for effecting disposal thereof. Several of these methods employ a forklift unit in order to lift and move a disposable waste container onto one of several different types of trucks adapted to transport and off load these containers. A suitable forklift unit 10 is illustrated in FIGS. 1 to 3 and it will be understood that this unit is constructed so that it is large enough and strong enough to lift and move a disposable waste container such as the illustrated container 12. Although suitable forms of forklift units have been illustrated in the drawings and are described hereinafter, it will be understood by those skilled in the art that a variety of known forklift units having sufficient capacity and lifting strength can also be used to carry out at least some of the methods of receiving and transporting solid waste disclosed herein.

The illustrated forklift unit 10 has a U-shaped body 14 which can be constructed of tubular frame members. These frame members can include U-shaped upper frame member 16 and a generally U-shaped lower frame member 18, with these two frame members connected by relatively short, vertically extending connecting tubes 20. Mounted at the forward end of the body 14 are two front wheels 22, one of which can rotate freely while the other is a driven wheel. Alternatively, if desired, both wheels 22 can be driven by suitable drive mechanisms such as those described hereinafter. Each wheel 22 is mounted in a U-shaped wheel bracket 24 with two forwardly extending legs in the form of vertical plates. Each wheel 22 is rotatably mounted on a relatively short shaft (not shown) which is rotatably supported at each end by means of suitable standard bearing units (not shown). A chain sprocket 26 is mounted between one of these bearings and one wheel 22 which, in the illustrated version of the lift unit, is the right side wheel as viewed from the front of the lift unit. Continuous drive chain 28 extends around the sprocket and this drive chain can be driven by an electric motor 29 powered by a standard battery, for example, a car battery.

As shown in FIGS. 1 and 3, the lift unit has a vertically extending support frame 30 of sufficient height to permit the lift unit to lift the waste container 12 onto a truck such as the truck 31 illustrated in FIG. 1. In one embodiment, the height of the frame is between 4 feet and 4.5 feet and the frame's bottom end is about six inches above the ground. The frame 30 has two vertical frame members, which can be channel members 32, connected together at the top by horizontal connecting strip 34. A lower portion of each channel member 32 is rigidly connected to the body 14 on a front side thereof. To add further rigidity, triangular brace members 36 can be used to secure the channel members to the upper frame member 16.

Shown in FIG. 1 on the right side of the lift unit is a metal box 38 which can be used to house the aforementioned battery which, as indicated, can be a standard 12 volt car battery. Mounted on the left side of this box is a metal housing 40 and located within this housing is an electrical DC motor operable on 12 volts, a hydraulic pump operated by the motor, and a hydraulic oil tank or reservoir having a one gallon capacity. The motor and pump can be of standard construction and a detailed description herein is deemed unnecessary. A standard push-button control can operate the motor and pump. Both the box 38 and the housing 40 are mounted on the rear side of the body 14 and between them is a vertically extending hydraulic cylinder 42 which has an extendible rod 44 projecting from its top end. The cylinder 42 is rigidly mounted to the horizontal strip 34 and at its bottom end to the body 14. The top end of rod 44 is connected to L-shaped actuator arm 46. This arm has a relatively short, horizontal portion 48 and a relatively long vertical section 50. The rod 44 can be extended or retracted by operation of the motor and pump to provide required pressurized hydraulic fluid.

Mounted on the lower portion of the actuator arm 46 is a fork carriage or fork supporting frame 54 (see FIG. 3). Extending forwardly from the frame 54 are two wide fork members 52. In one particular version of this forklift unit, the fork members have a width of about eight inches (as compared to only four inches in some known lift trucks of similar size). One preferred form of the container 12 measures about forty inches in each horizontal direction. Thus, with these wide forks, this preferred lift unit is able to lift even a relatively weak disposable pallet as described hereinafter with its waste container and contents resting thereon without damage being caused to or without failure of the support pallet during a lifting and moving operation. It will be understood that it is possible to construct the forks of standard fork width in some cases but, in such a case, it may be necessary to provide a stronger pallet than would otherwise be the case.

It will be understood that both sides of the fork frame 54 are fitted with wheels or rollers that can run up and down in their respective adjacent channel member 32. In this way, vertical movement of the fork frame is guided by the supporting frame 30. As indicated, the height of the supporting frame 30 can be about 4 to 4.5 feet in one embodiment but it will be appreciated that the height of the frame 30 can vary depending upon particular lifting requirements for the waste removal method. For example, the illustrated truck 31 has a fairly low transporting bed 57. Depending on the type of truck, the transporting bed can be three, four or more feet above ground level.

Rotatably mounted on the body 14 are two closely spaced rear wheels 60. These wheels are mounted at the center of the body 14 and substantially to the rear of the body. In one version of this unit, these wheels are ten inches in diameter. The lower frame member 18 can be bent upwardly along a central section thereof to accommodate turning movement of these wheels. The wheels 60 are mounted on a vertical shaft so that they can pivot together about a vertical axis in order to steer the lift unit. The unit is steered manually by means of an elongate handle member 62 which can be biased to the upwardly extending position shown in FIG. 1 by a suitable spring 63.

Figure 13:
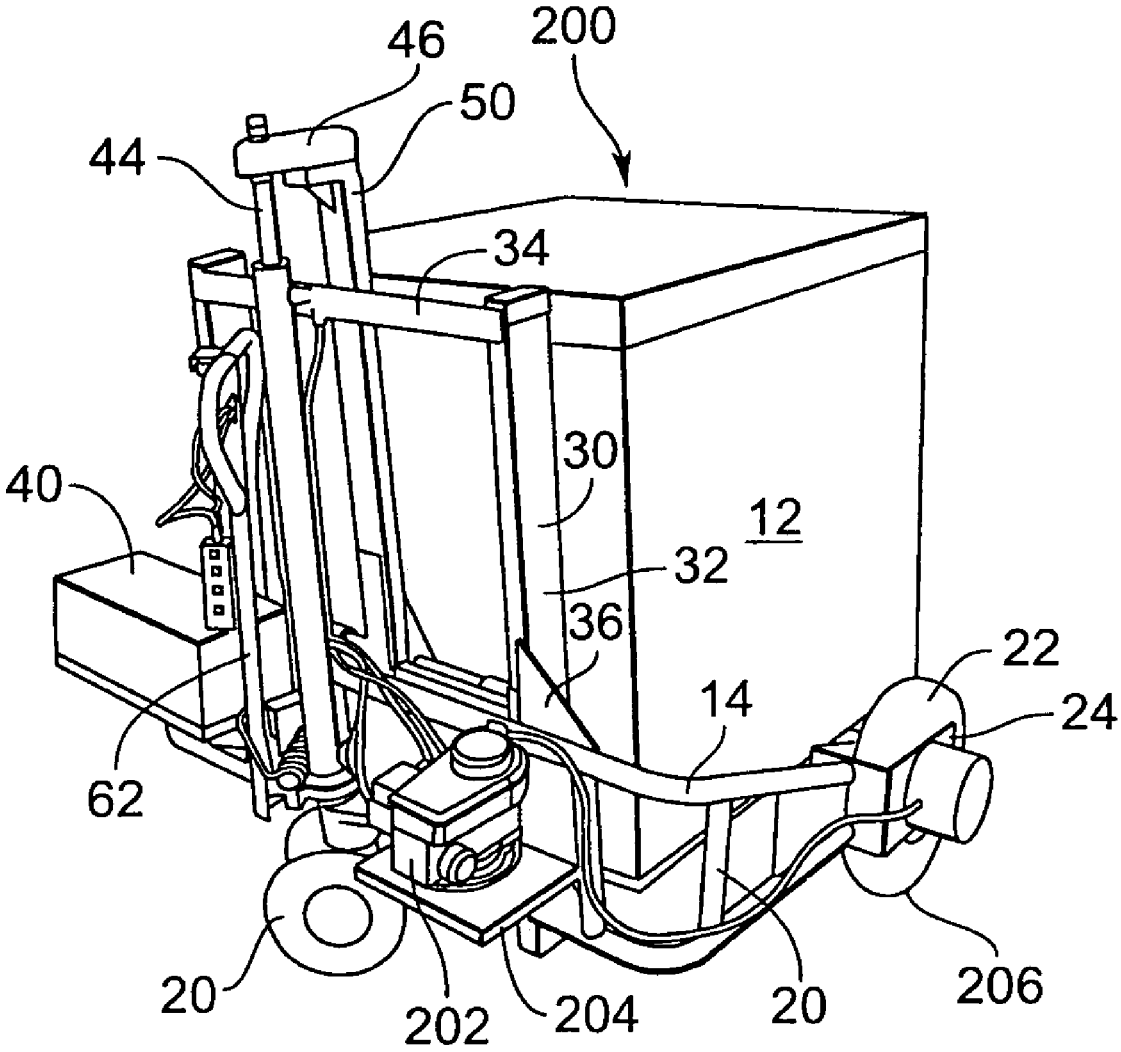
FIG. 13 is a perspective view of another version of a forklift unit with a disposable waste container mounted thereon, this view being from the rear and from one side.

An alternate forklift unit 200 that can be used for the present methods of waste disposal is illustrated in FIG. 13. The unit 200 is constructed in substantially the same manner as the unit 10 described above except as explained hereinafter. Instead of being electrically powered by a battery, the unit 200 is powered by a gasoline engine 202 which can be mounted on support platform 204 that is rigidly attached to the rear of the body 14. One suitable form of gas engine is 6 HP Briggs & Stratton engine. The motor can be started manually by a pull cord or by a battery powered electric starter if desired. Both wheels 22 in this forklift unit are driven by respective hydraulic motors 206 which can be mounted on the outer surface of the wheel brackets 24 and can be operatively connected to each wheel's axle. The hydraulic motor 206 can operate in forward and reverse and there is also a neutral motor control position. Preferably the forklift has a maximum lifting and moving capacity of at least 2000 lbs and has a usable straddle width of 50 inches (i.e. capable of accommodating containers having a horizontal width of 50 inches). A brake lever is preferably provided on the handle 62 to enable horizontal forklift movement to be stopped by wheel brakes (not shown) when required.

Turning now to the construction of the waste container 12 that can be used in the present method of receiving and transporting solid waste, one form of this container can be a corrugated cardboard box constructed of strong corrugated cardboard panels which are biodegradable. As shown in FIGS. 1 and 2, the box can have a cubical shape with four square (or rectangular) side panels 70 and a bottom panel or bottom panels at 72 which can be integrally connected to the side panels. Preferably the box or container is also provided with a removable and replaceable cardboard top 74. This top can have a square or rectangular horizontally extending panel 76 and extending about the perimeter of this panel is a cardboard edge flange 78. The edge flange can, for example, extend three to four inches down from the top panel 76. The top 74 should be sized and constructed so that it fits snugly on the open top of the main body of the container. In this way, a friction fit is formed between the edge flange 78 on the four sides of the top with the side panels 70. In one particular, cubical version of the container, the external dimensions of the container are 40"×40"×40". For reasons of economy and efficiency, the two horizontal dimensions of the container can be made the same as the horizontal dimensions of a separate, disposable pallet 80 on which the waste container is placed so that the container is in condition for loading of the solid waste into the container at a waste producing site. One form of disposable pallet that can be used is illustrated separately in FIGS. 9 and 11 of the drawings and is described further hereinafter.

The waste container 12 should have a sufficient waste capacity to hold a reasonably large amount of waste since a construction site or renovation site can produce significant quantities of solid waste. A preferred embodiment of the waste container has a waste capacity of at least 500 lbs of suitable solid waste and in a particularly preferred version of the container the waste capacity is at least 1000 lbs. of suitable solid waste. The term "suitable solid waste" as used herein is meant to refer to typical solid waste materials such as those generated at construction, renovation and clean-up sites. This waste can be reasonably heavy, for example, the weight of wood, chunks or pieces of bricks or blocks and pieces of wallboard and it is sized normally to fit within the dimensions of the waste container. Obviously if the waste material is a particularly light material which has a relatively large volume, for example, insulation material, then the waste container may not hold 500 lbs. of such light material and still have a dimension of only forty inches in each direction. It will be appreciated that not only does the preferred container have the capacity and strength to hold the aforementioned amount of waste material but also the pallet 80 on which the container sits during the waste collection process is constructed to have sufficient strength and rigidity to hold a fully loaded waste container.

Figure 10:
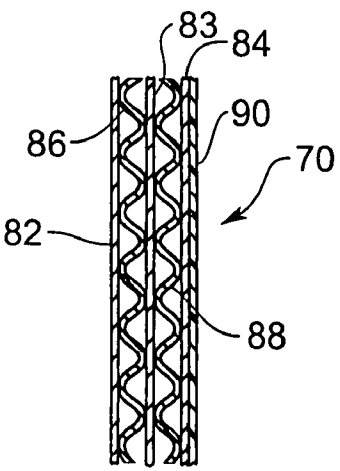
FIG. 10 is a cross-sectional detail view of a portion of a cardboard panel used to construct the container shown in FIG. 1, this view being taken along the line 10-10 of FIG. 1.

FIG. 10 illustrates the cross-section of one form of cardboard panel from which the waste container 12 can be constructed in order to have sufficient strength and rigidity. At least each side panel 70 and the bottom panel or panels can be made with a triple wall panel which includes three spaced-apart paper sheets 82 to 84 with sheet 83 being a central sheet. Between parallel sheets 82 and 83 is a corrugated paper sheet 86 which is secured by adhesive to sheets 82 and 83. Similarly, between sheets 83 and 84 is a second corrugated paper sheet 88. It will be understood that these paper sheets are preferably biodegradable so that they will eventually decompose when the waste container is dumped in a landfill site. However, in one desirable embodiment of the waste container, the exterior of each of these cardboard panels is coated with a water and moisture impervious layer 90 which can take the form of a thin, plastic sheet or layer that adheres to the outside surface of the paper sheet 84 or that is bonded to this sheet by means of a suitable adhesive. The cardboard top 74 can be constructed in the same manner and can also be covered with a water and moisture impervious layer. With the use of this layer 90 on the exterior of all of the cardboard panels, the waste container can withstand inclement weather even if it is exposed to such weather when the container is left at a waste producing site, such as a construction site. In order to protect the inside cardboard material of the container, the top 74 can be put on top of the main body of the container during wet weather conditions.

As an alternative to a waste container made of strong corrugated cardboard panels, it is also possible to construct the waste container from suitably strong and rigid plastic panels. Plastic panels or plastic boards that can be used for purposes of a waste container include those called "cloroplast" or "corrugated plastic". As such plastic boards are already known in the plastic industry for other purposes, for example, plastic signs, a detailed description of this material herein is deemed unnecessary.

According to one form of the method of receiving and transporting waste disclosed herein, the waste container 12 can initially be provided to a customer, such as a home renovator, in a collapsed flat state and then the user of the container can expand, unfold and tuck the container panels to form a usable waste container such as that shown in FIGS. 1 and 2. It will be appreciated that it is easy to ship and provide the containers in a collapsed flat state as they take up very little room in this condition and, if appropriate, a number of the collapsed, flat containers can be shipped together so that the renovator or other waste producer can create a number of waste containers as and when required. The collapsed, flat containers can also be shipped with a number of disposable pallets as described herein which preferably are nestable so that they also can readily be shipped in a compact state.

Turning to FIG. 1 of the drawings which shows one form of truck 31 that can be used to carry out one form of the method of receiving and transporting solid waste according to this disclosure, the truck 31 can be similar in size to a standard cube van and have similar capacity. The front section of the truck cannot be seen in FIG. 1 but it will be understood that it can be the same as that for cube vans currently in use. The truck has a rear end transporting section 92 which can include longitudinally extending, parallel sidewalls 94, 96 and a front wall 98 that connects together the sidewalls. The top of the rear end section is closed by a top wall or roof 100. The transporting section 92 is located above and is supported by rear wheels 102 of the truck. Although the truck 31 is shown with an open rear end to allow the waste container to be placed into the transporting section 92, it will be understood that this open rear end can be closed by means of a standard, suitable door (not shown). The door, can for example, be of the well known roll-up type which, in the open position, is supported by rails along the inside surface of the roof 100. After one or more waste containers have been placed in the transporting section 92, the door is closed so that the waste containers are secured within the enclosed transporting section 92.

Unlike the standard cube van, however, the truck 31 is fitted with a conveyor system 104 which can be used to move each loaded waste container 12 and its respective pallet 80 together to a forward position on the transporting bed 57 of the truck. As illustrated, the conveyor system 104 is arranged on and forms at least a substantial portion of the transporting bed. The conveyor system can comprise at least one series of rollers 106 extending from a rear end of the truck to a forward point, for example, the point 108 close to or adjacent a front end of the transporting bed 57. The rollers 106 of the or each series extend parallel to one another and in a transverse direction to a longitudinal centerline of the transporting bed, this centerline being indicated by the dot-dash line A. As illustrated, there are three series of rollers in the truck 31, these series being indicated at 110 to 112. These rollers are arranged to position a series of waste containers in two adjacent rows in the longitudinal direction. It will be appreciated that there could be more than three series of rollers or less than three depending on the size of the containers to be placed in the truck, the particular construction and size of the rollers being used, and the manner in which the containers are to be arranged. As illustrated, each series of rollers on the truck 31 is separated from an adjacent series by a longitudinal gap 114 or 116, each forming a walkway for a person to move a pallet and its respective waste container to a forward position in the truck by pushing on the waste container. The walkway formed by the gap forms a solid, unmoving surface for the person loading the container to walk on. The rollers themselves can be standard metal rollers which can be placed very close to the adjacent rollers in order to form a reasonably continuous rolling surface for the container and its pallet. Such a conveyor system is suitable for supporting and moving the pallet 80 illustrated in FIGS. 9 and 11 and described hereinafter. It will be appreciated that once the container 12 has been moved as far forward as possible in the transporting section 92, it can be secured in this position by suitable tie down straps of standard construction or by ropes. These straps or ropes can be tied or fastened to attachment loops or tie down bars (not shown) provided on the inside of the cube van. Such tie down mechanisms are well known in transport trailers and accordingly a detailed description herein is deemed unnecessary.

Using the truck 31, for example, to transport solid waste for disposal, the method of transporting the solid waste includes providing the disposable waste container 12 and the separate disposable pallet 80 which is capable of supporting the waste container 12 when the latter is loaded with solid waste. After the container and pallet have been provided to a waste producing site, the fully expanded container is placed on the pallet so that the container is in condition for loading the solid waste into the container at the site. Then, after the waste container has been loaded in whole or in part (to the extent desired by the waste producer) and is ready for transport to a disposal site, the pallet and the container can be lifted and moved by the forklift unit 10 onto a rear end section of the truck 31. Then, as explained above, the pallet and waste container can be moved together to a forward position on the transporting bed of the truck by means of the conveyor system 104. It will be understood that the truck may already be partially loaded with several waste containers 12 in which case the newly added container 12 is normally moved as far forward as possible in the transporting section 92 of the truck, that is to a point up against the already loaded containers and then the newly added container is secured in its position by means of ties or straps. The one or more pallets and waste containers are then transported by means of the truck to the waste disposal site for disposal at the site. It will be appreciated that they can be readily unloaded from the truck by simply rolling each waste container and its pallet off the rear end of the truck using the one or more series of rollers of the conveyor system.

Figure 6:
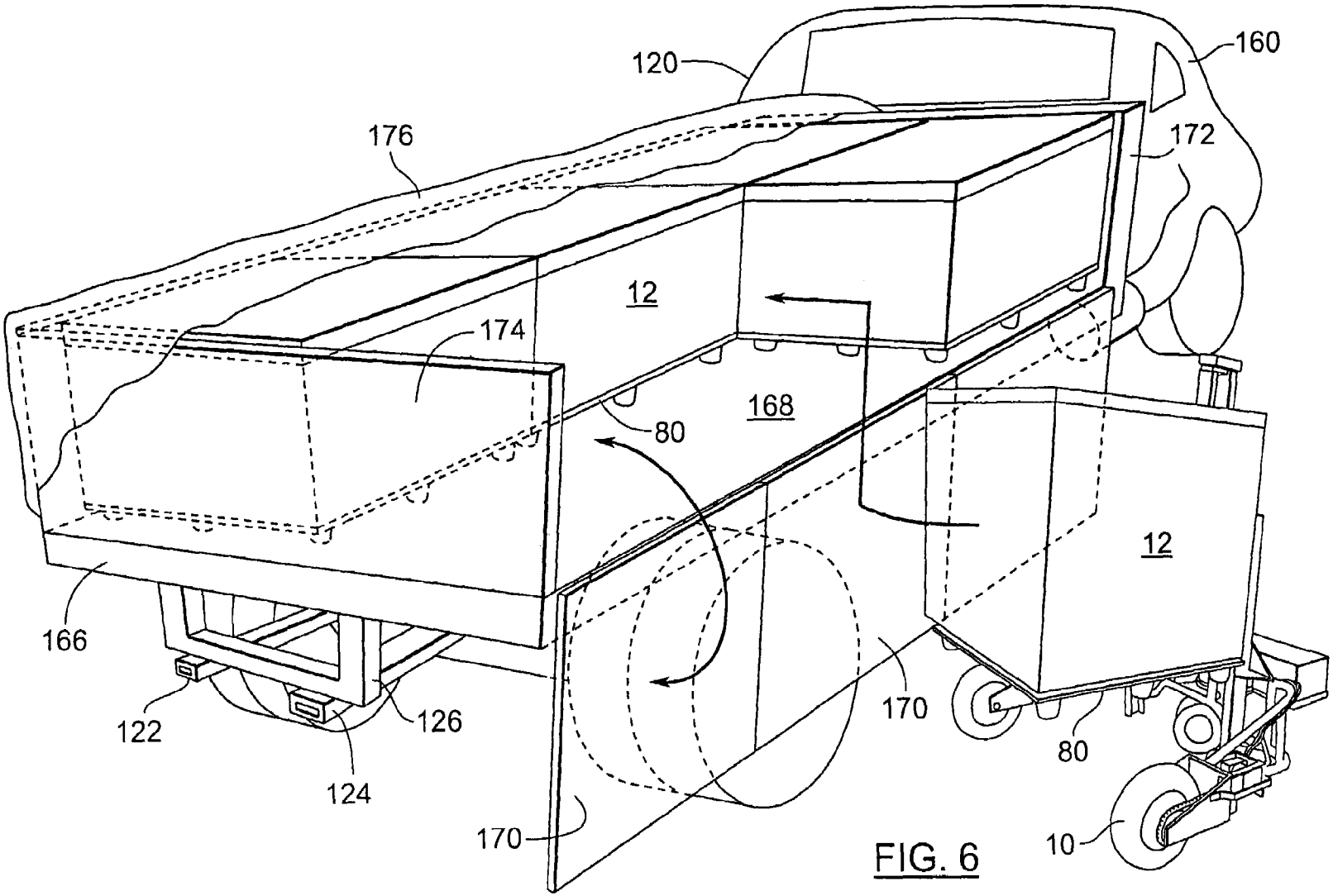
FIG. 6 is a perspective view illustrating an alternate form of waste disposal truck and a forklift unit being used to lift a waste container onto a flat bed of the truck, this view being taken from above and from the rear end of the truck.
Figure 7:
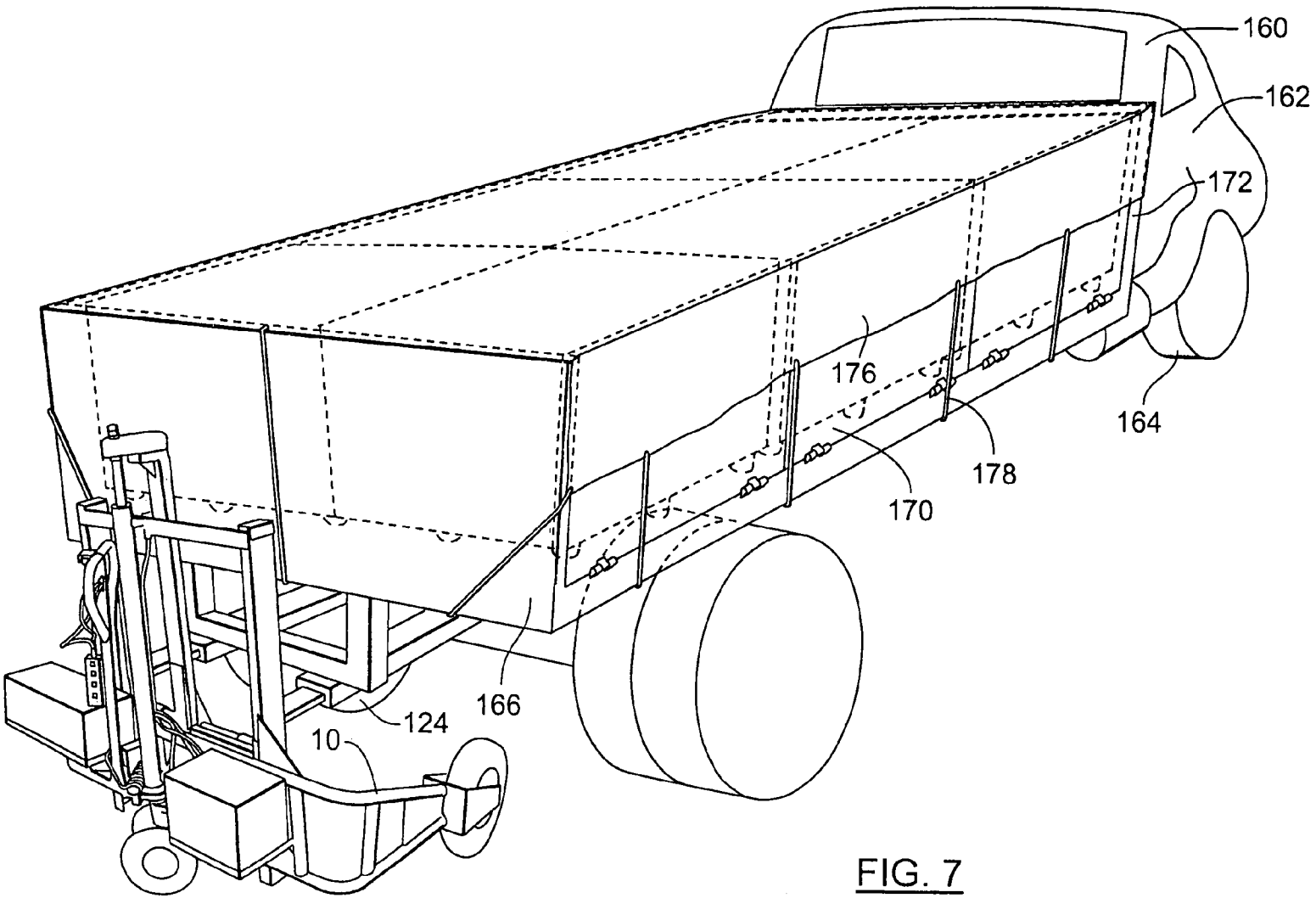
FIG. 7 is a perspective view of the truck of FIG. 6 with the forklift unit mounted on the rear end of the truck for transport and the sides of the rear transporting section of the truck raised to an upright position.

As shown on the waste disposal truck 120 of FIGS. 6 and 7 (but omitted from the truck of FIG. 1), the waste disposal truck used in one or more of the presently described methods can itself be used to transport the forklift unit 10 to the waste producing site when the waste container 12 is ready for transport to the waste disposal site. There can be mounted at the rear end of the truck 31 or the truck 120 a pair of tubular sockets 122, 124 which are supported by a pair of U-shaped supports 126, only one of which can be seen in FIG. 6. The supports 126 are rigidly connected to the rear ends and the forward ends of the sockets and they can be connected at the top to the underside of the truck bed. It will be understood that the fork members or tines 52 of the forklift unit 10 can be raised to a position where they are the same height as the sockets 122, 124 and then, by moving the forklift unit forwardly, the tines can be inserted into these sockets. When the fork tines have been inserted into the sockets, hydraulic power can then be applied to the fork to move it downwardly relative to the supporting frame 30. However, because the tines are unable to move downwardly relative to the back end of the truck, the rest of the fork lift unit 10 including the U-shaped body 14 and the wheels are raised from the ground to the position illustrated in FIG. 7, a position for transport. It will be appreciated that by transporting the forklift unit in this manner, all of the transporting bed of the truck is left available for transporting waste containers. Accordingly, the truck 31 fitted with the tine-receiving sockets 122, 124 at its rear end can be used to transport the forklift unit 10 to the waste producing site where the forklift unit can be unloaded from the truck. Then the forklift unit can be used to lift and move the pallet and its waste container which can include lifting and moving the pallet and waste container onto the rear end section of the truck as described above.

Figure 4:
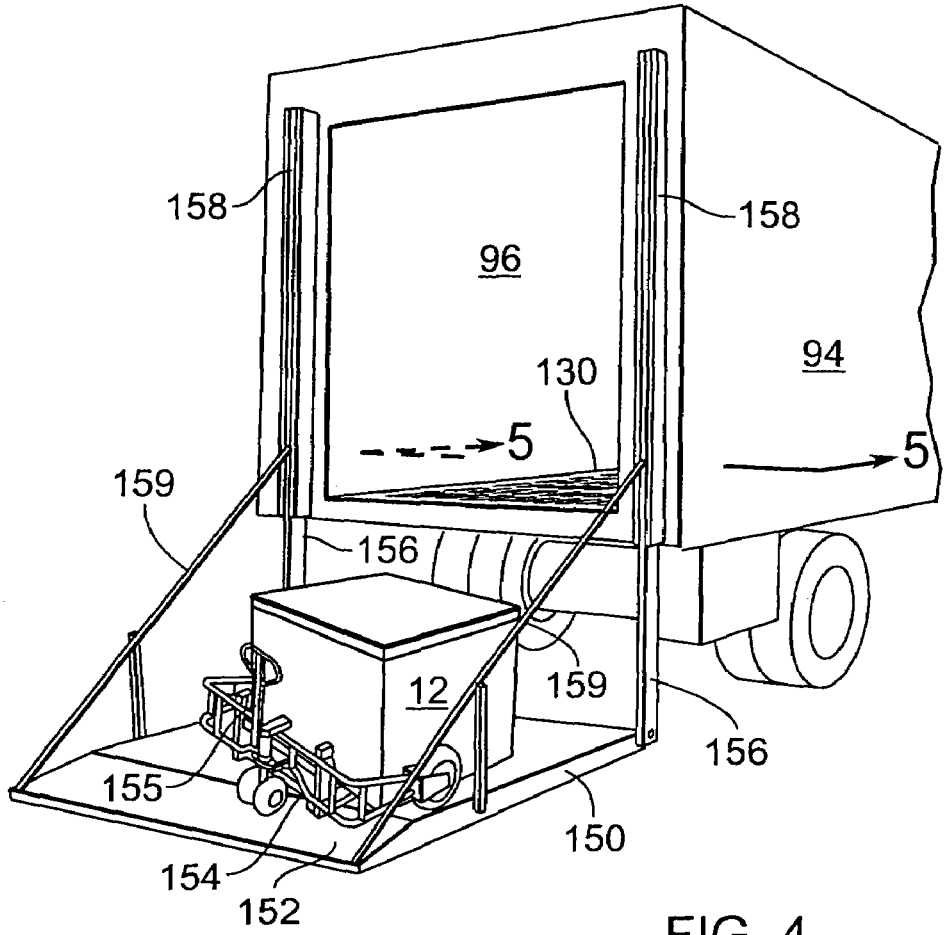
FIG. 4 is a schematic perspective view showing a rear portion of a waste disposal truck fitted with a power lift gate and showing a pallet jack depositing a waste container on the lift gate.
Figure 5:
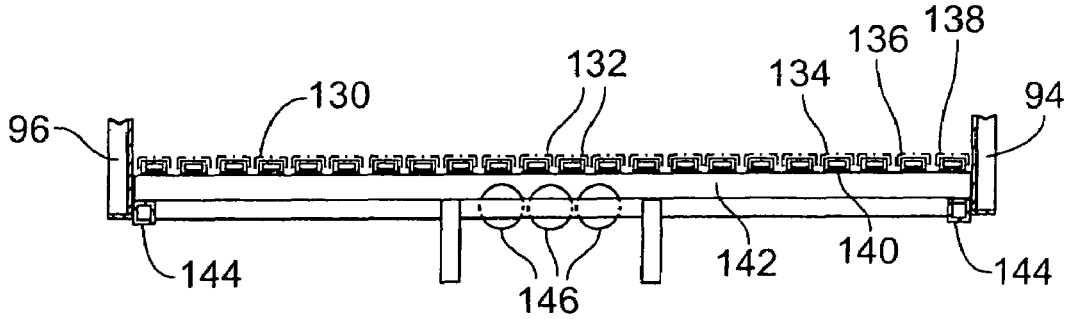
FIG. 5 is a cross-sectional detail view showing a flat conveyor floor in the rear container section of the truck of FIG. 4, this view being taken along the section line 5-5 of FIG. 4.

FIGS. 4 and 5 illustrate a rear end transporting section of another truck fitted with an alternate form of conveyor system that can be used to move the waste containers 12. Except for the conveyor system indicated generally at 130 and except for the power lift gate unit described hereinafter, the truck of FIGS. 4 and 5 can be constructed in the same manner as described above in connection with truck 31 of FIG. 1. The conveyor system 130 comprises a reciprocating slat conveyor having a plurality of elongate, parallel slats 132 extending parallel to one another and parallel to the central longitudinal axis (see the axis A of FIG. 1) of the transporting bed of the truck. It will be understood that this slat conveyor is capable of moving each pallet and its respective waste container in two different directions, the first direction being towards a front end of the transporting bed and the second direction being towards the rear end of the transporting bed. As a variety of suitable reciprocating slat conveyors are known in the transporting industry (and in other industries as well), a detailed description of such a slat conveyor system herein is deemed unnecessary. Examples of known reciprocating floor conveyors or slat conveyors can be found in U.S. Pat. Nos. 4,184,587, 5,222,590 and 5,522,494, the disclosures and drawings of which are incorporated herein by reference.

As illustrated in FIG. 5 which shows a vertical cross-section of a typical reciprocating conveyor system mounted inside a transporting container of the truck, a multiplicity of slats 132 are positioned side-by-side across the internal width of the rear transporting section of the truck. The slats can be arranged in a plurality of groups each having three slats, 134, 136 and 138 for example with each of these slats being connected to and moved by a different drive beam member. In a known manner, three of these transverse drive beam members can be provided along with an associated hydraulic drive cylinder, for example, capable of moving its respective drive beam member and the slats connected thereto. To explain further, each of the slats 134, 136, 138 is secured to its respective transverse drive beam for movement therewith in the longitudinal direction. Elongate guide members 140 are rigidly secured to the flat bed of the truck and they are used to guide the elongate slat members in their reciprocating movement. These guide members can, for example, be supported on a series of transverse frame members 142 which extend between the two upstanding sidewalls 94 and 96 of the truck. Transverse beams can be connected to each other by means of two longitudinally extending side beams 144 which can be box beams as shown. Illustrated centrally in FIG. 5 are three hydraulic cylinders which, as indicated, can be used to power the transverse drive beams and the slats connected thereto. Also, in a known manner, an anti-friction bearing can be mounted on each of the guide members 140 to provide sliding support for the associated slat. In a known manner, the slats can be moved in a suitable sequence of steps to move a container placed thereon either forwardly or rearwardly in the rear end section of the truck.

Although it is known to use a reciprocating slat conveyor in a waste conveying transport vehicle, such slat conveyor systems have generally been used to transport ordinary commercial waste that has simply been dumped into the transport vehicle where it rests on the reciprocating conveyor slats until it is time to unload the truck at a waste disposal site. When the truck reaches the waste disposal site the reciprocating slat conveyor is then used to dump the garbage from the rear end of the truck. However, unlike this known waste transport and waste disposal method, the reciprocating slat conveyor when used in a waste disposal truck in the present method, is used for two purposes, not only for off loading or dumping but also to load the relatively heavy waste containers 12 and their respective pallets onto the truck from the rear of the truck.

Also illustrated by FIG. 4 of the drawings is an alternate method of receiving and transporting solid waste according to the present disclosure. In this method the truck is equipped with a powered, rear end lift gate which can be of standard lift gate construction, if desired. This lift gate 150 can form a horizontal platform with a short, sloping ramp 152. In order to lift and move the waste container 12 (which is constructed in the manner described above) onto the lift gate, a standard pallet jack 154 can be used. This pallet jack can, for example, be an all terrain pallet jack manufactured and sold by Vestil Manufacturing Corporation of Angola, Ind., USA. It has a strong tubular frame and is designed to travel over rough ground such as that often encountered at construction sites. It can be fitted with relatively large 17" pneumatic front tires located at the front of the jack on both sides and two rear steering wheels of ten inch diameter. It is able to lift a container having a maximum width of four feet. If desired or if required, the two tines of the known pallet truck can be widened as described above from 4" to 8" in order to handle a disposable pallet with a fully loaded waste container mounted thereon. It is fitted with an elongate handle member 155 that can be used not only steer the two rear wheels but also to manually jack the fork tines to a raised position. The fork tines in the known pallet jack can be raised, for example, from a point three inches above ground level (measured from the front edge of the tine) to nine inches above ground level. This distance is sufficient to enable the pallet jack to lift and move the waste container onto the lift gate 150. The lift gate can be used to raise either the container and its pallet by themselves to the level of the truck bed or the container, its pallet and the pallet jack to the level of the truck bed. In the latter case, the pallet jack can then be used to move the container and its pallet onto the truck bed. Then, if the truck is equipped with a conveyor system, this conveyor system can be used to move the container 12 (as described above) to a forward position in the rear container section of the truck. In the alternative, if only the container and its pallet are placed on the power lift gate, the power lift gate itself can be provided with a conveyor mechanism, such as rollers, to move container 12 from the horizontal surface of the lift gate onto the truck bed. Although the lift gate can be constructed in different known ways, the illustrated lift gate has two vertically movable and vertically extending support beams 156 which are connected to the lift gate platform at the two corners furthest from the ramp 152 and closest to the rear end of the truck. The lift gate platform is pivotably connected to these vertical beams so that it can be swung upwardly to a vertical position when the loading operation has been completed and the truck is ready to transport its load.

The vertical beams 156 are movable in vertical guideways 158 that are provided at the rear ends of the sidewalls 94, 96 of the truck. Co-ordinated hydraulic cylinder jacks can, for example, be used to raise and lower the beams 156 together with the lift platform. Extending from each support beam 156 to a rear corner of the lift platform is a support cable 159. The two cables help to maintain the platform horizontal as the lift gate is raised with its load and they also help to support the weight of the lift platform and its load. If desired, the cables 159 can also be used to pivot the lift platform from the horizontal position to the vertical position for transport after the lift gate has been raised. This can be accomplished by connecting one end of each cable to a suitable winch mechanism (not shown) mounted in the truck. Alternatively, if the platform of the lift gate is sufficiently light and not unduly large, it can be pivoted manually to an upright position at the rear end of the truck after the loading operation has been completed.

FIGS. 6 and 7 illustrate another form of truck 160 that can be used to carry out one form of the present method of receiving and transporting solid waste for effecting disposal thereof. The truck 160 can have a front end section 162 similar to that of a standard cube van with two front wheels 164. The truck 160 is equipped with a rear transporting portion 166 having a flat, horizontally extending transporting bed 168 visible clearly in FIG. 6. The illustrated bed is substantially rectangular and is sized, for example, to accommodate six disposable containers 12 in the manner shown. However, it will be appreciated that the number of containers can vary depending upon the actual size of the truck bed used and also on the size of the waste containers and their respective pallets 80. As illustrated, there are two longitudinally extending rows of the containers 12 and each row can have three containers. The rear transporting portion 166 is equipped with longitudinally extending sidewall members 170 that can be moved from an upright transporting position (this position being shown in FIG. 7) to a second position which allows the container and pallet to be loaded onto the truck, the latter position being shown on the right side of the truck in FIG. 6. In the illustrated truck 160 there are three of these sidewall members 170 on each side of the truck but it will be understood that there could be as few as one sidewall member on each side or there could be more than three. If one, long sidewall member is used on each side, it can be quite heavy and suitable power means such as a hydraulic motor or hydraulic cylinder can be used to pivot the sidewall member from its upright position to its down position and vice versa. The sidewall members can be pivotably mounted by means of suitable hinges connected to their bottom edges and connected to the longitudinal side edge of the bed 168. Alternatively, the sidewall members can be made completely removable so that they are simply moved out of the way when the truck is to be loaded with a waste container. For example, each sidewall member can comprise a metal panel made of a light weight material such as aluminum and at least a couple of posts attached to one side of the metal panel, these posts extending vertically when the sidewall member is arranged in the upright position shown in FIG. 7. The posts can then extend into suitable sockets formed along the longitudinal edge of the rear transporting portion of the truck.

The rear transporting portion 166 can be provided with a front wall 172 located just behind the cab and a rear wall 174 which extends across the rear end of the truck and extends upwardly from the transporting bed 168. Preferably the height of these walls is at least as high as the height of the combination of each container 12 and its respective pallet 80 (as shown). After one or more of the containers 12 and their respective pallets have been loaded onto the bed 168 using the above described forklift unit 10, the containers can be covered and protected from rain, wind, etc., by means of a suitably sized tarp 176. The tarp 176 is shown in its secured position over the containers in FIG. 7 and it can be held in position by means of tie down straps or cords 178 that are connected to the edge of the tarp at spaced apart locations. One end of each tie down can be connected to a suitable connecting loop or other attachment device located underneath the transporting bed or at the side edge of the bed 168. Preferably the tarp is secured so that it does not flap or move as the truck 160 is driven down a road or highway.

Figure 8A:
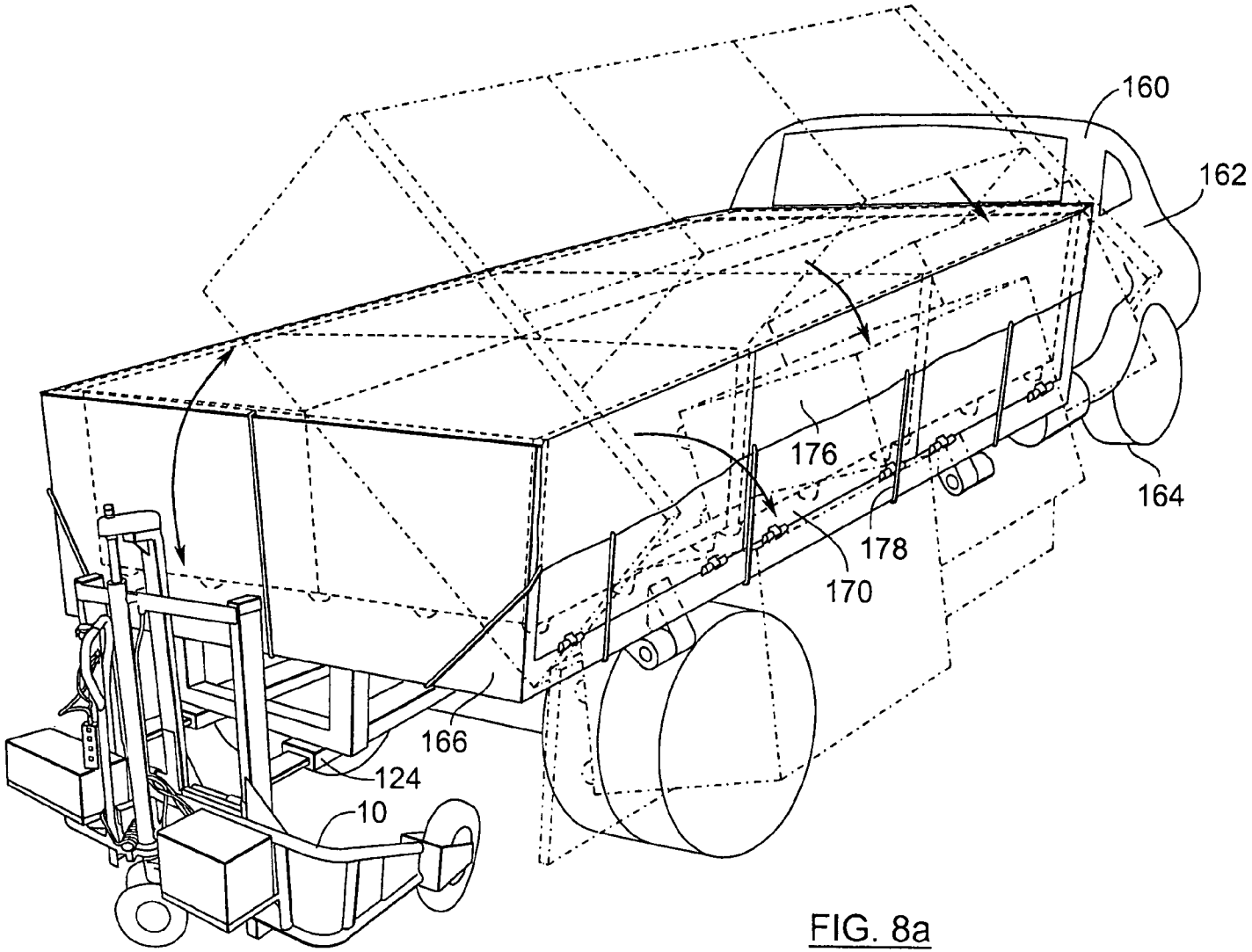
FIG. 8*a* is another perspective view of the truck shown in FIG. 7, this view illustrating the side dumping feature of the truck in dot-dash lines.
Figure 8B:
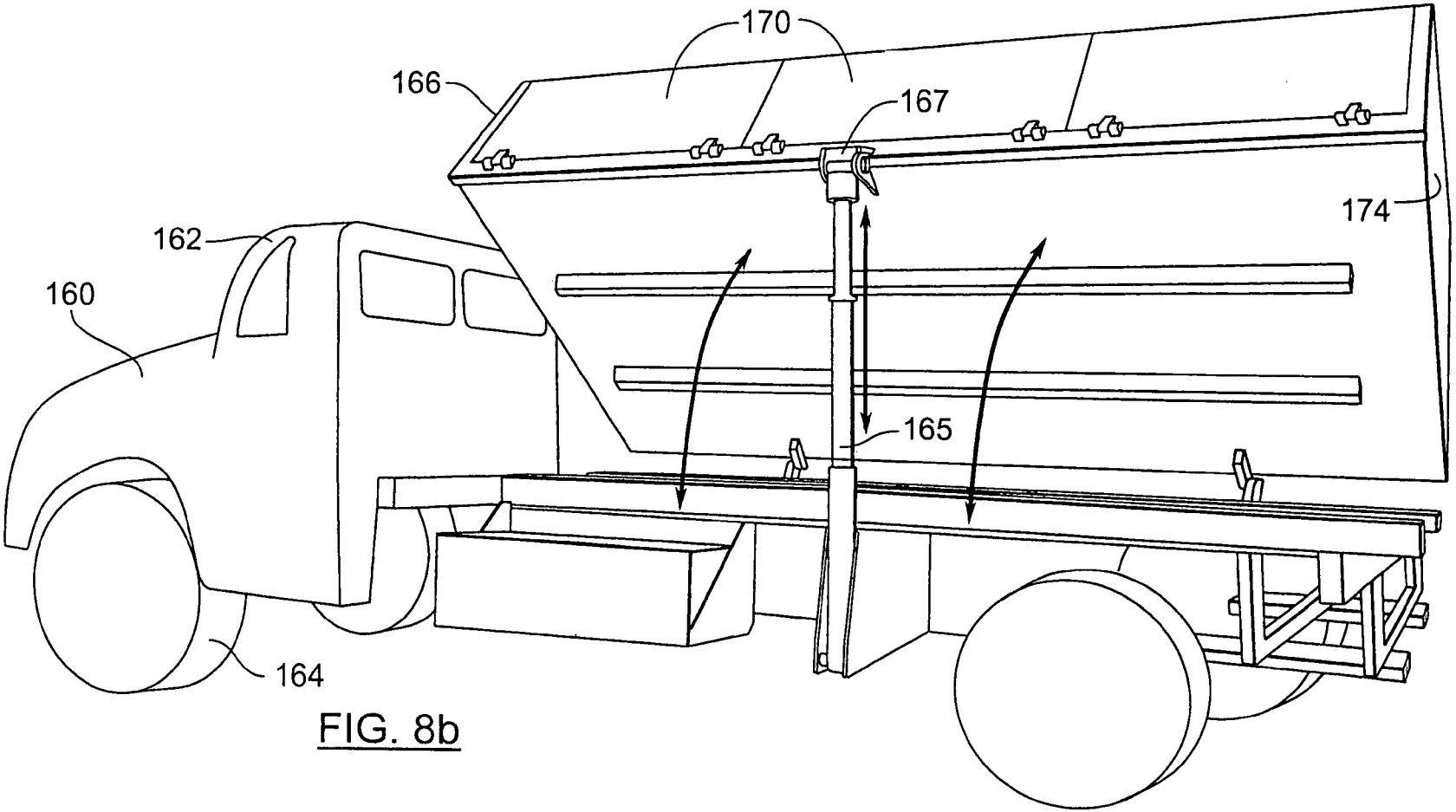
FIG. 8*b* is a perspective view of the truck shown in FIG. 7, this view being taken from the left side and showing the rear transporting portion raised to the dumping position by a hydraulic cylinder unit.

FIG. 6 illustrates how a forklift unit 10 can be used to move a pallet 80 and a waste container onto the transporting bed 168 from a respective longitudinal side of the rear transporting portion 166. It will be understood that in the case where there are two longitudinal rows of containers, the containers in the right-side row (as seen in FIGS. 6 and 7) are loaded from the right side of the truck 160 while the containers in the left side row are loaded from the left side of the truck after one or more of the side wall members on the left side of the truck are lowered or removed. Again, after one or more of the pallets and waste containers have been placed on the truck, they can be transported by means of the truck to a waste disposal site. The pallets and their respective waste containers can then be dumped at the waste disposal site because the truck 160 is fitted with a raising mechanism 165 for raising the transporting portion 166 from a horizontal transporting position (that shown in FIGS. 6 and 7) to a sloping position for dumping the contents of the transporting portion 166. A raising mechanism is commonly used, for example, on standard dump trucks used to move granular products such as gravel or sand. The illustrated raising mechanism 165 is a hydraulic cylinder mechanism which can have several telescoping rod sections and which is be pivotally mounted at the upper rod end 167. In the case of the truck 160, the raising mechanism can be arranged and placed so as to dump the truck load from one longitudinal side of the truck after the sidewall members on that side have been lowered or removed completely, this side dumping aspect being illustrated in dot-dash lines in FIG. 8*a*. The advantage of a side dumping truck is that the forklift unit 10 can remain in place on the rear end of the truck (the position shown in FIG. 7) while the load of containers and pallets is being dumped. The fork lift unit 10 has been omitted from FIG. 8*b* for ease of illustration only. Although it is also possible to use a rear-dumping truck in order to move and dispose of these containers and pallets, if the forklift unit 10 is mounted at the rear end of such a truck, it must be removed from the rear end of the truck before the dumping operation takes place.

Figure 9:
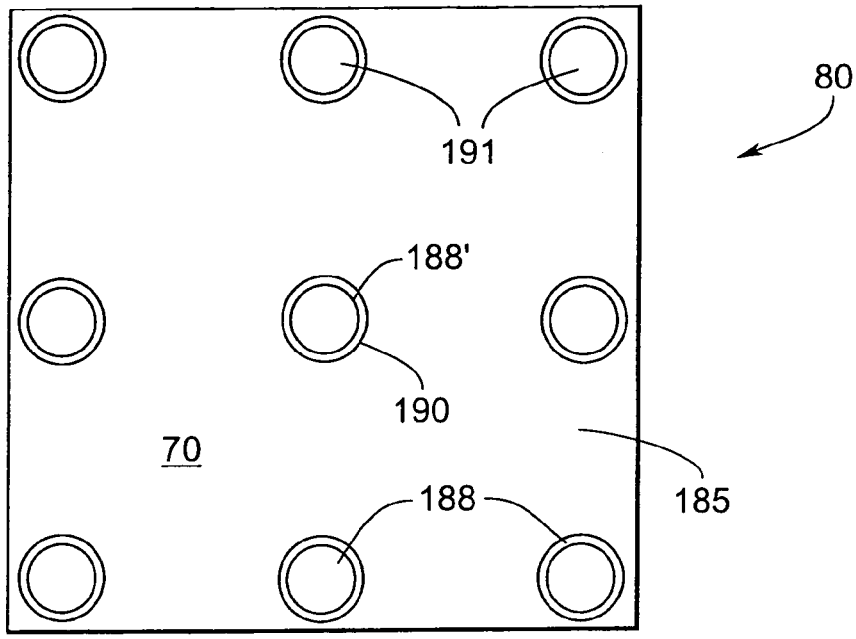
FIG. 9 is a top view of a disposable pallet that can be used to support the waste container.
Figure 11:
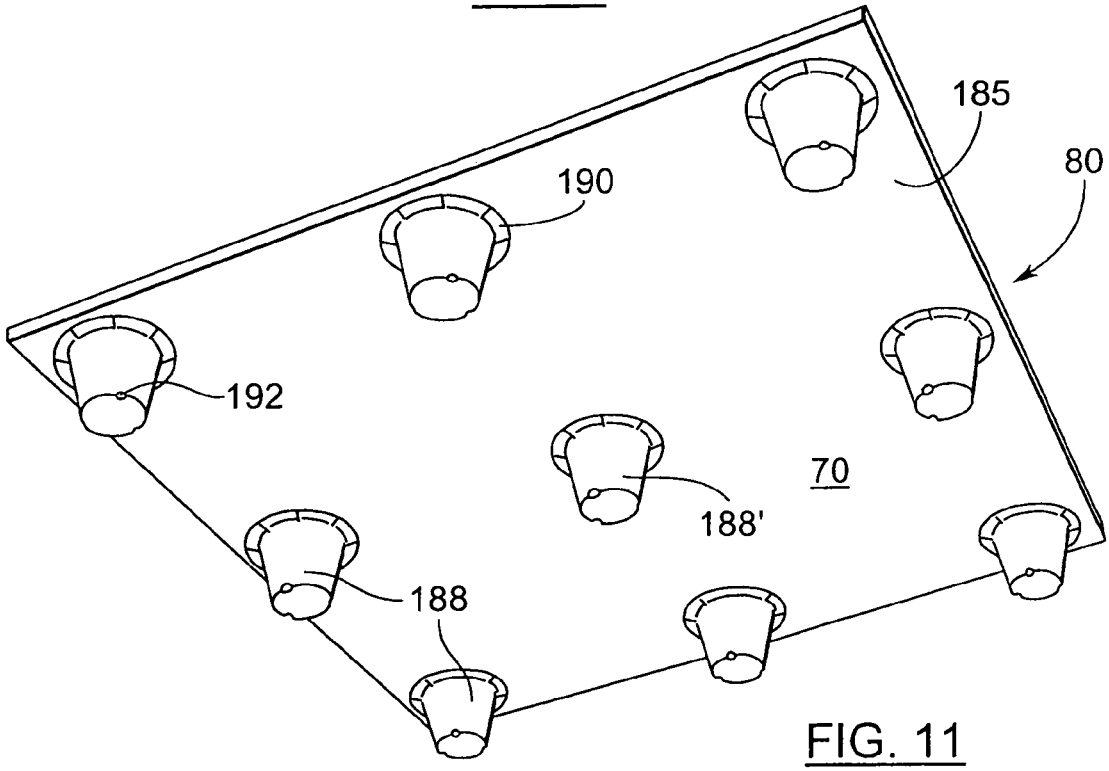
FIG. 11 is a perspective view of the pallet of FIG. 9, this view being taken from below and from one side of the pallet.

Turning now to the disposable pallet 80 illustrated in FIGS. 9 and 11, this pallet has a planar, substantially rectangular support member 185 made of biodegradable material such as strong, rigid cardboard material. If desired, this cardboard material can be made and constructed in a manner similar to the panels of the waste container itself as described above. In one embodiment, the support member 185 is a triple wall panel and, if desired, at least the upper surface thereof can be coated with a plastic layer in the manner illustrated in FIG. 10. The pallet also has a plurality of plastic cup-shaped leg members 188 which are capable of supporting the support member 185 above ground or above a floor during use of the pallet. Four of these leg members 188 are located at four corners of the support member and an additional four of the leg members can be located midway between a respective two of the leg members located at adjacent corners of the support member. There is also a central leg member indicated at 188' located in the centre of the pallet. Each leg member 188 can be formed at its wider top end with an outwardly extending connecting flange 190 which can be used to secure the leg member to the bottom of the support member 185, for example, by means of staples. Each leg member is located below a circular hole 191 formed in the member 185. In this way, the pallets 80 are made stackable and nestable so that a plurality of them can easily be stored and transported without taking up a lot of room. It will be understood that the pallet 80 is dimensioned in the lengthwise and widthwise directions so that its dimensions correspond to those of the waste container 12 to be placed thereon. In order that water will not accumulate in the open topped leg members, they are provided with at least one and preferably two or three small drainage holes 192 at each of their bottom ends. The leg members are made from a suitably strong plastic material such as PVC. It will be understood that the leg members are spaced apart a sufficient distance in the lengthwise and widthwise direction to permit insertion of the forklift tines from any of the four sides of the pallet. This permits the pallet and its container to be readily picked-up by the forklift unit even if the pallet and waste container have been placed near a wall or other obstacle.

Figure 12:
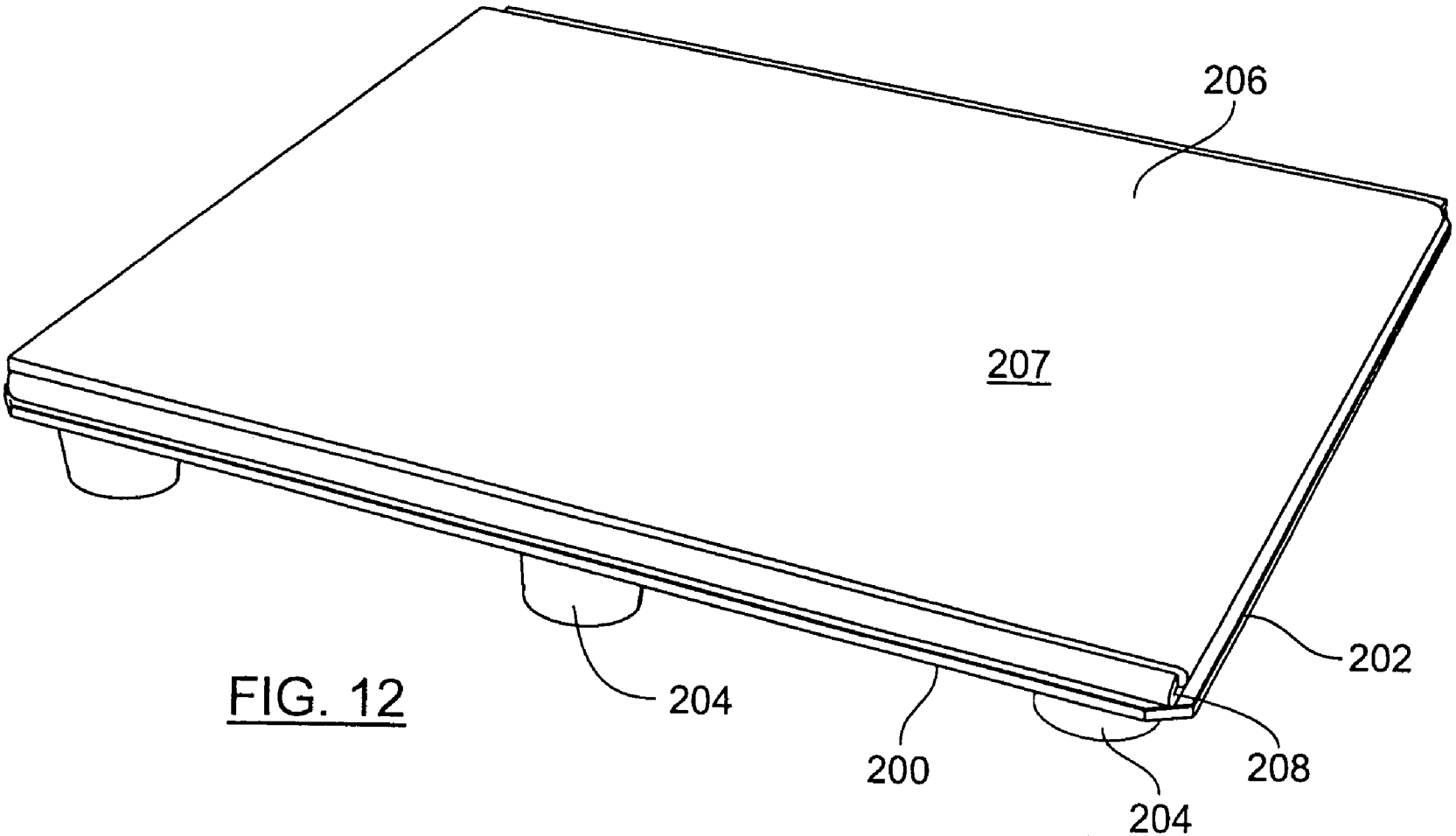
FIG. 12 is a perspective view taken from above of a second form of disposable pallet made of chipboard with a folded disposable container affixed to its top surface.

Instead of the aforementioned construction for the pallet, it is also possible to construct a disposable pallet from wood-chip material and a suitable adhesive or binder to hold the chips together. This material is commonly referred to as "chipboard" in the construction industry. A disposable pallet 200 of this type is illustrated in FIG. 12. With the use of this material, the flat, square upper portion 202 of the pallet can be formed integrally with the leg members 204 which would still have the same general shape as the plastic leg members 188 shown in FIGS. 9 and 11. The integral leg members are also constructed with an open top so that the pallets can be stacked one on top of the other without requiring an undue amount of storage or transporting space.

According to another aspect of the present methods of waste disposal and as illustrated in FIG. 12, it is also possible to ship the disposable waste containers to the user in a collapsed, folded and flat state attached to the top of the disposable pallet. Such a collapsed container is indicated at 206 and it will be seen that the side panels 207 are folded on top of a square bottom panel structure 208. The bottom of the container can be secured, for example, by staples and/or adhesive to the top of the pallet. The container is then expanded, unfolded and tucked while secured to the pallet.

As will be apparent to those skilled in the disposal of waste materials and in the transportation of same, various modifications and changes can be made to the described methods of receiving and transporting waste using a disposable waste container without departing from the spirit and scope of this invention. Accordingly, all such modifications and changes to the described methods as fall within the scope of the appended claims are intended to be part of this invention.

The invention claimed is:

1. A method of receiving and transporting solid waste, said method comprising:

providing a disposable waste container having a waste capacity of at least 500 pounds of solid waste and a disposable pallet capable of supporting said waste container when said container is loaded with said solid waste to a user for use at a waste producing site, said waste container having an exterior surface made of a water and moisture impervious layer;

after said waste container has been loaded in whole or in part by said user with said container resting on and supported by said pallet and is ready for transport to a disposal site, lifting and moving said pallet and waste container onto a transporting bed of a truck by means of a separate forklift unit, said truck having a rear transporting portion that includes said transporting bed, said rear transporting portion having longitudinally extending sidewall members that can be moved from an upright transporting position on a respective longitudinal side of said rear transporting portion to a second position which allows said container and pallet to be loaded onto the truck, at least one of said sidewall members being moved to said second position to allow said pallet and waste container to be moved onto said transporting bed from the respective longitudinal side of said rear transporting portion and then being moved back to said upright transporting position, said truck also having a raising mechanism for raising said rear transporting portion from a horizontal transporting position to a sloping position for dumping contents of said transporting portion;

transporting said pallet and waste container by means of said truck to a waste disposal site; and dumping said pallet and said waste container at said waste disposal site by operating said raising mechanism.

2. A method of receiving and transporting waste according to claim 1 wherein said disposable waste container is constructed of corrugated cardboard panels which are biodegradable.

3. A method of receiving and transporting waste according to claim 2 including transporting said forklift unit to said waste producing site by means of said truck when said waste container is ready for transport to the disposal site and unloading said forklift unit from said truck prior to using said forklift unit to lift and move said pallet and waste container onto said transporting bed.

4. A method of receiving and transporting waste according to claim 2 wherein said cardboard panels are triple wall panels and the waste container has length, width and height dimensions of at least three feet for each dimension.

5. A method of receiving and transporting waste according to claim 2 wherein said waste container is provided in a collapsed flat state to a user and can be unfolded, and tucked to form a usable waste container at the waste producing site, said container, when expanded, measures at least 3 feet long by 3 feet wide, and said container includes a removable and replaceable cardboard top.

6. A method of receiving and transporting waste according to claim 5 wherein said waste container in a collapsed flat state is secured to a top side of said disposable pallet before the waste container and pallet are provided to the user and the waste container is constructed so that the container can be unfolded and tucked while secured to the disposable pallet.

7. A method of receiving and transporting waste according to claim 2 wherein said pallet comprises a planar, substantially rectangular support member made of biodegradable material and a plurality of plastic cup-shaped leg members capable of supporting said support member above ground or above a floor during use of said pallet, four of said leg members being located at four corners of the support member and an additional four of said leg members each being located midway between a respective two of the leg members located at adjacent corners of the support member.

8. A method of receiving and transporting waste according to claim 1 wherein said waste container is constructed from triple wall cardboard panels which are biodegradable.

9. A method of receiving and transporting waste according to claim 1 wherein said rear transporting portion is pivotable about a pivot axis that is parallel to a longitudinal central axis of the truck and said raising mechanism is operated to pivot said rear transporting portion about said pivot axis in order to dump said pallet and said waste container from one longitudinal side of the truck at said waste disposal site.

10. A method of receiving and transporting waste according to claim 9 wherein said forklift unit is transported to and from said waste producing site by mounting said forklift unit at a rear end of said truck with forks of said fork lift unit inserted in fork holding receptacles mounted on said truck at said rear end thereof below said transporting bed and wherein a rear, upright wall is provided on said truck at said rear end of the truck in order to hold any pallets and their containers on said transporting bed during use of the truck.

11. A method of receiving and transporting waste according to claim 1 wherein said waste container is constructed of corrugated plastic panels which are impervious to water and moisture and said panels are sufficiently strong and rigid to permit said container to hold at least 500 pounds of solid waste.

* * * * *